United States Patent [19]

Hara

[11] 4,184,139

[45] Jan. 15, 1980

[54] THERMAL CUT-OFF FUSE

[75] Inventor: Kunio Hara, Kawasaki, Japan

[73] Assignee: Illinois Tool Works Inc., Chicago, Ill.

[21] Appl. No.: 937,225

[22] Filed: Aug. 28, 1978

[30] Foreign Application Priority Data

Aug. 29, 1977 [JP] Japan ..... 52-114521[U]

[51] Int. Cl.[2] ..... H01H 37/76

[52] U.S. Cl. ..... 337/407; 337/408

[58] Field of Search ..... 337/407, 408, 409

[56] References Cited

U.S. PATENT DOCUMENTS 3,930,215 12/1975 Senor ..... 337/407

4,109,229 8/1978 Plasko ..... 337/408

FOREIGN PATENT DOCUMENTS 46-15922 3/1971 Japan ..... 337/407

*Primary Examiner*—George Harris

*Attorney, Agent, or Firm*—Glenn W. Bowen; Robert W. Beart

[57] ABSTRACT

In a thermal cut-off fuse of the type in which a resilient contactor interposed between the electrodes opposed to each other inside a housing is bulged with the pressure resulting from insertion of a thermal pellet inside the housing so as to establish an electric circuit between the electrodes, desired reduction in the contact resistance between the contactor and the electrodes is accomplished by the improvement which comprises having formed on each of the opposite surfaces of the contactor confronting the opposed electrodes a plurality of raised contacts adapted so that all the raised contacts will remain in fast contact with the electrodes so long as the thermal pellet retains its solid state.

3 Claims, 7 Drawing Figures

THERMAL CUT-OFF FUSE

BACKGROUND OF THE INVENTION

This invention relates to a thermal cut-off fuse of the type in which a thermal pellet remains in a solid state and, consequently, the electric continuity between lead wires is kept intact while the ambient temperature is below a preset level and, when the ambient temperature rises above the preset level, the solid thermal pellet is melted and, consequently, the electric continuity between the lead wires is broken.

The electric cut-off fuse is an element which is used for the purpose of breaking an electric circuit when the electric current flowing through that circuit increases excessively. In contrast, the thermal cut-off fuse is an element which serves the purpose of breaking an electric circuit when the ambient temperature of the fuse rises excessively. Common household electric appliances which have heating sources such as hair driers, stoves and cookers are invariably fitted with a thermal cut-off fuse as a safeguard against excessive heating. The thermal cut-off fuse is available in various designs, some consisting solely of fusible metal wires and others comprising plugs and cases containing such fusible metal wires. Even fusible metal wires of a specific type vary considerably in their melting temperatures and, therefore, do not provide accurate temperature response. Therefore, when such wires are used in electric appliances having heat sources, the metals must have melting temperatures which are considerably lower than the lowest allowable temperatures prescribed for perfect safety of the appliances. To overcome this inconvenience, there has been developed an improved thermal cut-off fuse which uses a thermal pellet made of resin or fatty oils capable of melting precisely at a specific temperature.

The conventional thermal cut-off fuse has an electroconductive housing and contains therein the aforementioned thermal pellet capable of retaining its solid state below a prescribed temperature level and a resilient metal ring which, in its original free state, has a size amply accommodated within the housing and, upon being deformed by the pressure resulting from the insertion of the thermal pellet in the housing interior, has parts thereof brought into contact with the inner wall of the housing, with one of the lead wires connected to the housing and the other lead wire to the metal ring. The case of a heat-generating appliance to which electric current is supplied through the medium of such a thermal cut-off fuse will now be cited as an example. The supply of electric current to the appliance proceeds so long as the ambient temperature is below the prescribed temperature level. If some abnormality develops within the appliance and the amount of heat generated by the appliance consequently increases so much as to exceed the prescribed level, then the thermal pellet inside the thermal cut-off fuse begins to melt. Melting of the pellet results in a reduction of the volume thereof so that the solid pellet no longer applies pressure to the metal ring and the metal ring is allowed to resume its original state by virtue of its own resiliency. This means that the parts of the metal ring so far held in contact with the inner wall of the housing separate from the wall to break the electric continuity between the lead wires. Consequently, the supply of electric current to the appliance is discontinued to prevent the appliance from excessive heating. Thermal cut-off fuses of this type are finding widespreading acceptance because of their many advantageous such as compactness, simplicity of structure and sensitive response. They nevertheless have a disadvantage in that the metal ring and the inner wall of the housing are brought into contact at points or along lines of limited area as viewed cross-sectionally so that the contact resistance consequently generated tends to become high. When the contact resistance is high, the portions involved generate heat during the passage of electric current. The volume of heat thus generated increases with increasing flow of current. There is a consequent possibility that the heat will melt the thermal pellet. With the conventional thermal pellet, therefore, the rated response temperatures are always fairly low so much that the thermal cut-off fuses are usable only in electric appliances of low capacities.

An object of this invention is to provide a thermal cut-off fuse having very low electric contact resistance and heat generation thus making it possible to produce thermal cut-off fuses with high response temperatures that safely cut off the supply of electric current precisely at the time that the ambient temperature reaches the prescribed level.

SUMMARY OF THE INVENTION

To accomplish the object described above according to this invention, there is provided a thermal cut-off fuse which comprises in combination a housing having a pair of electrodes opposed to each other therein, a thermal pellet disposed inside the housing and adapted to be melted at a prescribed temperature, and a resilient contactor interposed between the opposed electrodes and possessing a plurality of outwardly raised contacts adapted so that when the molded thermal pellet retains its solid state, the raised contacts of the contactor are pushed against the opposed electrodes by the pressure exerted by the solid pellet so as to keep the electric continuity of the electrodes and, when the molded pellet on reaching the rated temperature melts and is consequently diminished in volume, the contactor is relieved of the pressure and allowed to resume its original shape by its own resiliency and, consequently, the raised contacts separate from the electrodes and break the electric continuity of the electrodes.

The total area of contact between the contactor and the electrodes is substantially large because all the raised contacts formed on the resilient contactor are pushed against the electrodes while the solid thermal pellet exerts pressure upon the resilient contactor. Consequently, the contact resistance of the fuse becomes small enough for the thermal fuse to be effectively applicable to high-power heat generating appliances involving high rated temperatures.

The other objects and characteristic features of the present invention will become apparent from the description to be given in full detail hereinafter with reference to the accompanying drawing.

DESCRIPTION OF THE PREFERRED EMBODIMENTS

Figure 1A:
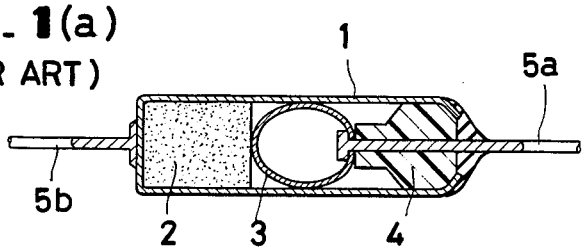
Fig. 1(a) (PRIOR ART)
FIGS. 1(*a*) and 1(*b*) are sectioned side elevations of a typical construction of the conventional thermal cut-off fuse.
Figure 1B:
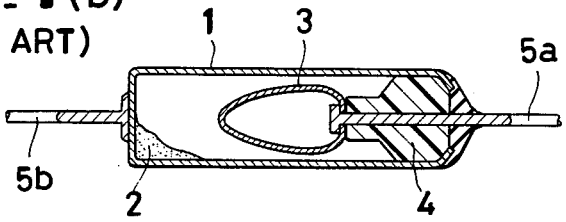
Fig. 1(b) (PRIOR ART)

A typical example of the conventional resilient ring type thermal cut-off fuse is shown in FIGS. 1(*a*) and 1(*b*). FIG. 1(*a*) illustrates two lead wires 5*a*, 5*b* retained in the state of electric continuity while the appliance served by the fuse remains at its normal working temperature below the rated temperature. Structurally, of the two lead wires, the lead wire 5*a* is inserted through an opening at the one axial end of the housing 1 and mechanically fastened to the opening end of the housing through the medium of an insulator 4 serving to keep the lead wire 5*a* electrically insulated from the housing and the other lead wire 5*b* is electrically connected generally to the other axial end of the electroconductive housing 1.

Inside the housing 1, a molded thermal pellet 2 which retains its solid state at the normal room temperature is places at the side opposite the side of the housing on which the lead wire 5*a* enters the housing. The pellet 2 thus occupies a portion of the interior space of the housing 1. Within the remaining portion of the interior space, a resilient, electroconductive ring 3 in its bulged state is disposed between the molded thermal pellet and the inner end of the lead wire 5*a*. At the two points of contact on its bulged sides, the metal ring is held in contact with the inner walls of the housing 1. At the position at which the ring 3 is pressed against the inner end of the lead wire 5*a*, the ring is electrically connected and mechanically fastened to the lead wire 5*a*. While the fuse is in the state described above, an electrical path is established from the lead wire 5*b*, through the housing 1, the points of contact and the resilient ring 3 to the other lead wire 5*a*.

The molded thermal pellet 2 begins to melt immediately after the temperature of the fuse, because of some malfunction of the appliance or an abnormal rise of ambient temperature, has risen to pass the level predetermined as the maximum at which the appliance can be safely operated.

Thermal pellets suitable for this purpose are available in various types. For example, various types are available for a wide range of rated temperatures. However, all thermal pellet respond faithfully at their rated temperature or melting temperature.

As the pellet 2 melts and assumes a liquid state, there ensues a voluminal change (reduction) as shown in FIG. 1(*b*). Consequently, the ring 3 ceases to be retained by the pellet and stretches to its original shape. As a result, the points of contact of the ring so far held in fast contact with the inner wall of the housing are separated from the inner wall to break the electrical continuity between the two lead wires.

The basic construction and operation of the conventional resilient ring type thermal cut-off fuse have been described. In any of the types of thermal cut-off fuses available to date, the resilient ring used therein has a generally circular shape. In the state of electrical continuity as illustrated in FIG. 1(*a*), therefore, the ring is held in contact with the inner wall of the housing only at points as viewed cross-sectionally. This means that the contact resistance at the points of contact is high. In case where a thermal cut-off fuse of this type is inserted in a power supply breaking circuit designed for passage of a rather small electric current, the contact resistance due to the contact of the ring at the points is by no means negligible and, in fact, results in a serious power loss or voltage drop. Further, the high contact resistance may cause the fuse to generate heat and melt the thermal pellet while the ambient temperature is still below the rated temperature. Thus, the conventional thermal cut-off fuse has been used only in electric appliances involving relatively low power consumption. Despite the remarkable simplicity of structure the thermal cut-off fuse, it has nevertheless been criticized for its high contact resistance.

The present invention has been accomplished with a view mainly to improving the contactor so as to diminish the contact resistance, a serious problem posed by the conventional resilient ring type contactor. It aims to overcome the much criticized shortcoming and enhance the advantage derived from the simplicity of structure so that the thermal cut-off fuse can be safely incorporated even in electric appliances designed to be operated with minute electric current.

Figure 2:
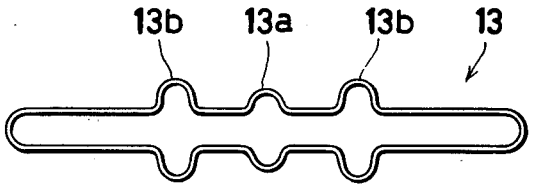
FIG. 2 is a sectioned side elevation illustrating a resilient contactor to be used in the first preferred embodiment of the thermal cut-off fuse of the present invention.

Now the present invention will be described in detail hereinafter with reference to the preferred embodiments illustrated. FIG. 2 represents a resilient contactor 13 of the shape of a depressed ring which is used in the preferred embodiment of this invention. The shape of the contactor 13 shown is that which the contactor assumes when it is relieved of external pressure and allowed by virtue of its own resiliency to resume the original size in which it is first produced. As shown here, this contactor has a plurality of outwardly raised portions 13*a*, 13*b* formed thereon. Specifically in the illustrated contactor, a total of six such raised portions are formed, three on each of the longitudinally opposed sections of the contactor at the opposite positions. These raised portions serve as separate contacts of the contactor. Of the three pairs of opposed raised contacts, those 13*a* in the middle have a smaller height than those 13*b* on the outer sides for a reason that will be explained later.

Figure 3A:
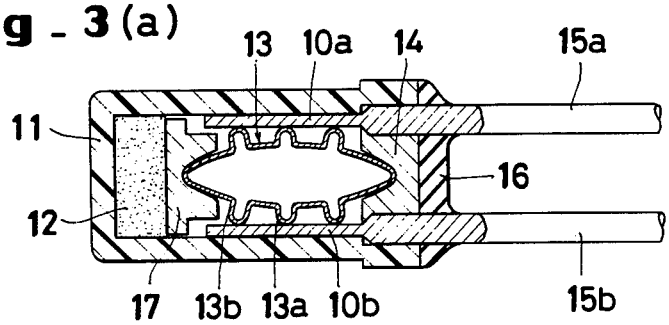
FIGS. 3(*a*) and 3(*b*) are sectioned side elevations illustrating one preferred embodiment of the thermal cut-off fuse using the resilient contactor of FIG. 2.
Figure 3B:
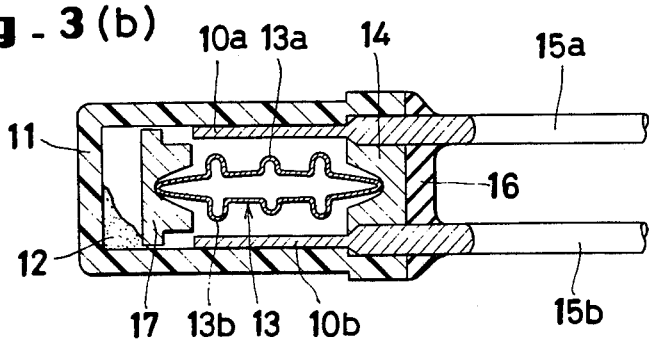

FIG. 3(*a*) represents a thermal fuse as one preferred embodiment of the present invention incorporating the contactor described above. The construction of this thermal cut-off fuse will be described. Inside a housing 11 which is hollow and open at one end, a pair of lead wires 15*a*, 15*b* adapted to retain the state of electric continuity at temperatures below a rated temperature and break the electric continuity when the temperature rises above the rated temperature are inserted in position. In the present preferred embodiment, the housing 11 is formed of an insulating material. Desirably it may be formed of a synthetic resin which permits easy molding. To the inner ends of the lead wires 15*a*, 15*b* are respectively connected electroconductive electrodes 10*a*, 10*b* adapted to provide direct contact with the periphery of the contactor. In the illustrated preferred embodiment, the electrodes 10*a*, 10*b* are formed as integral parts of the lead wires 15*a*, 15*b* by allowing proper lengths of the innermost ends of the lead wires inserted into the housing interior to be pressed so as to assume the shape of flattened plates.

On the closed end side of the housing interior, there is placed a thermal pellet 12 which, under normal conditions, retains a solid state and occupies a fixed volume. The open end of the housing is closed with support means 14 adapted to keep firm hold of one end of the resilient contactor. The support means 14 is an insulator and, in this particular case, serves an extra function of immobilizing the inner ends of the lead wires 15*a*, 15*b*.

Inside the housing 11, in the free space not occupied by the thermal pellet 12, the resilient contactor 13 shown in FIG. 3(*a*) is disposed in a compressed state. To be more specific, the contactor 13 is longitudinally compressed between the stationary support means 14 and the solid pellet 12 and is consequently bulged in a direction perpendicular to the direction of compression, with the result that the raised contacts 13*a*, 13*b* formed on the periphery of the contactor will be pressed against the corresponding electrodes 10*a*, 10*b*. In the illustrated embodiment, the inner end of the contactor 13 is pressed against the pellet 12 not directly but indirectly through the medium of slide means 17. This slide means ensures perfect parallellism of the movement of the contactor relative to the inner wall of the housing. When, as described in more detail later, the pellet melts and the contactor 13 is allowed to resume its original size, the slide means enables the consequent movement of the contactor to occur in a direction perfectly parallel to the opposed electrodes 10*a*, 10*b* so that the electric continuity of the contactor with the two electrodes will be safely and simultaneously broken. Basically it is permissible to omit use of such slide means and cause the pellet 12 to press the contactor directly.

The insertion of the contactor 13 in the manner described above completes the construction of the housing interior. Generally, added safety of the thermal fuse is obtained by externally sealing with a proper insulating material 16 the end of the housing which has already been closed with the aforementioned support means 14.

The construction of the thermal cut-off fuse of FIG. 3(*a*) is characterized by the fact that the resilient contactor 13 remains in contact with the opposed electrodes 10*a*, 10*b* extended from the lead wires 15*a*, 15*b*, not at one point each but at a plurality of points each and, consequently, the contact resistance is small as compared with that experienced in the conventional thermal cut-off fuse of FIG. 1.

On the assumption that the raised contacts 13*a* in the middle of the contactor correspond to the points of contact of the thermal cut-off fuse of FIG. 1, it is noted that the raised contacts 13*b* on the outer sides have a greater height. When the resilient contactor is bulged laterally as a whole by the pressure exerted as described previously, the longitudinally opposed sections of the contactor are pushed outwardly each in an arcuate shape toward the electrodes 10*a*, 10*b*. If the highest points of the arcs should come into contact with the respective electrodes 10*a*, 10*b*, then the arcs would be curved in such a way as to be separated increasingly more from the electrodes 10*a*, 10*b* with increasing distance from the points of contact. In the case of the illustrated embodiment, since the highest points correspond to the raised contacts 13*a*, it becomes necessary to give the raised contacts 13*b* on the outer sides extra height in a sufficient degree to offset the separation from the electrodes 10*a*, 10*b* due to the curvature of the curved sections. This explains why the contactor of the present thermal cut-off fuse should be formed in a shape as shown in FIG. 2. In the illustrated embodiment, the raised contacts 13*a* are formed where the longitudinally opposed sections of the contactor are inflated to the greatest width. Alternatively, these raised contacts 13*a* may be omitted so that the most bulged portions of the contactor will come into direct contact with the electrodes 10*a*, 10*b* substantially in the same way as shown in FIG. 1. In this case, it is necessary that raised contacts 13*b* with a sufficient height to come into direct contact with the electrodes 10*a*, 10*b* should be formed at points separated from the most bulged portions of the contactor.

As described above, the resilient contactor of the thermal cut-off fuse sufficiently fulfils its function when it is provided with a required number of raised contacts at the portions thereof other than the portions at which the contactor is bulged most under the pressure exerted by the pellet or the portions at which the bulged contactor comes into contact with or at least approaches most the electrodes extended from the lead wires, with the raised contacts given respective heights sufficient to take up the distances which separate the corresponding portions of the contactor from the electrodes.

The motion produced by this thermal fuse is not different from that of the conventional countertypes. When the temperature of the fuse rises to reach the rated level, the pellet 12 melts as shown in FIGS. 3(*a*), 3(*b*) and consequently diminishes in volume. The resilient contactor 13, thus relieved of the pressure exerted by the pellet, is allowed to resume its original shape, with the result that the portions of the contactor so far held in contact with the electrodes 10*a*, 10*b* (the raised contacts 13*a*, 13*b* in the case of the illustrated embodiment) separate from the electrodes to break the electric continuity of the contactor with the two lead wires 15*a*, 15*b*. (If the thermal cut-off fuse uses the aforementioned slide means 17, the resiliency of the contactor forces the slide means to slide toward the depth of the housing interior.)

As is evident from the description above, the present invention substantially constitutes itself an improvement in and relating to the resilient contactor for use in the thermal cut-off fuse. Thus thermal cut-off fuses of varying forms can readily be obtained by replacing resilient rings used in the conventional thermal cut-off fuses with the resilient contactor of this invention. This invention can be applied, for example, to a thermal cut-off fuse wherein the electrode of one of the lead wires in the form of an inner wall of a housing as in the electroconductive housing illustrated in FIGS. 1(*a*), 1(*b*). In this case, the electrode connected to the other lead wire has only to be insulated from the housing.

Figure 4:
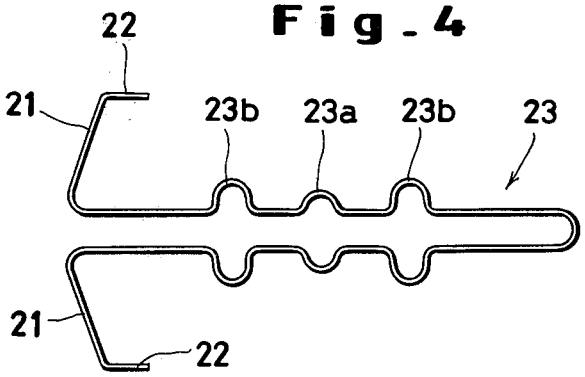
FIG. 4 is a side elevation illustrating a resilient contactor to be used in the second preferred embodiment of the thermal cut-off fuse of this invention.
Figure 5:
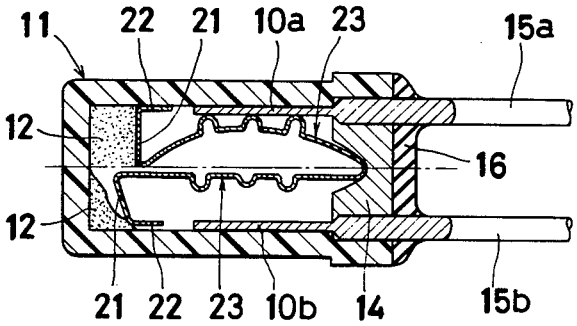
FIG. 5 is a sectioned side elevation of the thermal cut-off fuse using the resilient contactor of FIG. 4, illustrating the fuse in a state retaining the electric continuity and in a state wherein the electric continuity is broken.

The preferred embodiment illustrated in FIG. 5 omits the slide means 17 from the preferred embodiment described above and, instead, confers the function of the slide means 17 upon the resilient contactor, as shown in FIG. 4, with a view to simplifying the construction of the thermal cut-off fuse and at the same time eliminating the troublesome step of the insertion of the slide means into the housing interior in the course of the fuse assembly.

The contactor 23 involved in the present preferred embodiment is open on the side facing the pellet and extended in the shape of legs 21 stretched from the open end thereof toward the inner walls of the housing. The extreme ends of the legs are bent so as to form guide portions 22 adapted to slide along the inner walls of the housing. FIG. 5 shows the construction of the thermal cut-off fuse incorporating this contactor similarly to the thermal cut-off fuse of FIG. 4 (like symbols are used to denote like component elements). The upper half portion illustrates the contactor retaining its electric continuity with the electrode and the lower half portion illustrate the same contactor in a state wherein the electric continuity is broken.

As is evident from the drawing, so long as the contactor is pushed under the pressure exerted by the pellet 12, the two legs 21 are held in contact with the electrodes with uniform force to enhance the stability of the electric continuity and, at the same time, the two guide means 22 are depressed into the inner walls of the housing and the open ends of the contactor are consequently brought into mutual contact. This means that while the contactor retains its electric continuity with the electrodes, the open ends of the contactor thus brought into mutual contact adds all the more to the electroconductivity of the contactor. A flat plate made of a good conductor may be inserted between the two legs and the pellet to ensure further reduction in the contact rsistance.

The contactor 23 resumes its original shape when the pellet melts. While the contactor 23 is resuming its original shape, the guide means 22 slide along the inner walls of the housing in a well-balanced manner and the movement of the contactor consequently caused by its own resiliency proceeds safely and uniformly relative to the electrodes 10*a*, 10*b*. The uniform motion of the contactor precludes the otherwise possible phenomenon of chattering between the contactor and the electrodes.

In both the two preferred embodiments so far described, the resilient contactor and the support means 14 serving to support or press the contactor in position on the open end side of the housing are fastened relative to each other by the contactor being simply disposed inside the groove cut in the support means. Of course, it is permissible to have them fastened with added strength by use of an adhesive or by having one end of the contactor buried in the support means 14 at the time the support means is being molded.

The resilient contactor may be made of any of numerous known materials. Preferably it is made of a thin plate of beryllium which excels in springiness and electroconductivity. In working the present invention, the contactor of the thermal cut-off fuse is obtained by punching a piece in the shape desired for the contactor from a thin plate of beryllium by means of a press, subjecting the piece to a hardening treatment in an oxygen-free atmosphere, pickling the hardened piece and thereafter lacing the piece with silver or gold.

As concerns the springiness of the contactor, when the plurality of raised contacts are formed on the contactor to increase the points of contact, the resiliency acquired by each of the raised contacts contributes much to the overall springiness of the contactor.

As described above, the present invention effectively serves the purpose of remarkably reducing the inner resistance of the thermal fuse element itself by increasing the number of contacts at which the contactor is brought into contact with the two lead wires. It has other advantages such as improvement in the springiness of the contact, for example.

What is claimed is:

1. A thermal cut-off fuse, comprising in combination a housing having a pair of electrodes opposed to each other therein, a thermal pellet formulated to melt at a preset temperature and disposed inside the housing, and a resilient contactor provided with a plurality of outwardly raised contacts and adapted so that while the thermal pellet retains its solid state, the contactor has its electric continuity retained with the two electrodes by the raised contacts being pressed against the electrodes and, when the thermal pellet, upon reaching the preset temperature, melts into a liquid state and consequently diminishes in volume, the contactor is relieved of the pressure exerted by the pellet and is consequently allowed to resume its original shape by virtue of its own resiliency to break the aforementioned electric continuity, wherein the raised contact have their heights properly coordinated as by giving to those in the middle a smaller height so that when the contactor is pushed under the pressure exerted by the solid thermal pellet, the contact between the contactor and the electrodes is maintained uniformly at the tips of the raised contacts to ensure reduced contact resistance.

2. The thermal cut-off fuse according to claim 1, wherein the resilient contactor is in the shape of a substantially elliptic ring and is retained at one end thereof by support means and at the other end by slide means adapted to slide within the housing interior in accordance with the change of volume of the thermal pellet.

3. The thermal cut-off fuse according to claim 1, wherein the resilient contactor is open on the side facing the pellet and it is integrally provided at the open end thereof with legs adapted to exert pressure against the pellet and the legs are provided at their extreme ends with guide means adapted to slide along the inner walls of the housing.

* * * * *

UNITED STATES PATENT AND TRADEMARK OFFICE

CERTIFICATE OF CORRECTION

PATENT NO. : 4,184,139

DATED : January 15, 1980

INVENTOR(S) : Kunio Hara

It is certified that error appears in the above-identified patent and that said Letters Patent are hereby corrected as shown below:

In the heading change the name of the assignee from "Illinois Tool Works Inc., Chicago, Ill." to --Nifco Inc., Kanagawa-ken, Japan--.

Signed and Sealed this

*Twenty-seventh* Day of *May 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,184,139

DATED : January 15, 1980

INVENTOR(S) : Kunio Hara

It is certified that error appears in the above-identified patent and that said Letters Patent are hereby corrected as shown below:

In the "Foreign Patent Documents" section change the reference Japanese Number 46-15922 to 47-15922.

Signed and Sealed this

*Fifteenth* Day of *July 1980*

[SEAL]

*Attest:*

SIDNEY A. DIAMOND

*Attesting Officer*

*Commissioner of Patents and Trademarks*